US005775515A

United States Patent [19]

Chadwick

[11] Patent Number: 5,775,515

[45] Date of Patent: Jul. 7, 1998

[54] METHOD AND APPARATUS FOR WRAPPING COILS, AND THE WRAPPED PRODUCT

[75] Inventor: Dennis P. Chadwick, Napanee, Canada

[73] Assignee: Chadwick Engineering Limited, Kingston, Canada

[21] Appl. No.: 643,750

[22] Filed: May 6, 1996

[51] Int. Cl.[6] ..... B65D 85/66

[52] U.S. Cl. ..... 206/416; 206/410; 206/414

[58] Field of Search ..... 206/397, 398, 206/401, 410, 413, 415, 416, 407, 414; 53/409, 136.2, 204, 441, 442

[56] References Cited

U.S. PATENT DOCUMENTS

| | | | |
|---|---|---|---|
| 3,402,809 | 9/1968 | Snyder | 206/410 |
| 3,669,255 | 6/1972 | Raynus | 206/397 |
| 3,670,877 | 6/1972 | Reed | 206/59 F |
| 3,726,396 | 4/1973 | Birkner | 206/52 R |
| 3,942,638 | 3/1976 | Stone | 206/410 |
| 4,164,110 | 8/1979 | Soubeyrat | 206/397 |
| 4,523,421 | 6/1985 | Kataoka | 53/399 |
| 4,524,562 | 6/1985 | Yagi | 53/409 |
| 4,578,925 | 4/1986 | Matsunami | 53/409 |
| 4,819,408 | 4/1989 | Bertolotti | 53/211 |
| 4,829,753 | 5/1989 | Bricmont | 53/588 |
| 4,845,919 | 7/1989 | Fujii | 53/380 |
| 4,924,654 | 5/1990 | Langen | 53/399 |
| 4,928,454 | 5/1990 | Bertolotti | 53/409 |
| 5,003,753 | 4/1991 | Dornblaser et al. | 53/136.2 |
| 5,046,298 | 9/1991 | Norkoski et al. | 53/136.2 |
| 5,167,322 | 12/1992 | Lemaire | 206/397 |
| 5,282,347 | 2/1994 | Cleine | 53/204 |
| 5,346,067 | 9/1994 | Haufe et al. | 206/410 |
| 5,353,933 | 10/1994 | Takahashi et al. | 206/398 |
| 5,390,476 | 2/1995 | Morantz | 53/556 |
| 5,400,567 | 3/1995 | Lindstrand | 53/399 |

FOREIGN PATENT DOCUMENTS

| | | | |
|---|---|---|---|
| 0329764 | 2/1991 | Japan | 206/397 |
| 3187877 | 8/1991 | Japan | 206/397 |

*Primary Examiner*—Daniel Moon
*Assistant Examiner*—Ed Tolan
*Attorney, Agent, or Firm*—Richard J. Hicks

[57] ABSTRACT

A method and apparatus for wrapping coils of metallic strip and the like to protect against atmospheric corrosion, and the wrapped product are described. A plastic film sleeve is inserted through the open cylindrical center and held in place by flanged collars at each end. The sleeve is turned back over the collars and the ends are loosely stuffed into the open cylindrical center. The entire coil is then cocoon wrapped using relatively wide stretch-wrap film. The cocoon wrapping is then sealed to the turned-over sleeve in the vicinity of the end collars so as to seal the coil within a continuous plastic film. The excess cocoon wrapping and sleeve material overlying the cylindrical center can be trimmed away to leave an open center to receive coil handling equipment.

16 Claims, 4 Drawing Sheets

METHOD AND APPARATUS FOR WRAPPING COILS, AND THE WRAPPED PRODUCT

FIELD OF INVENTION

This invention relates to a method and apparatus for enveloping a coil of a continuous flexible material, such as cable, line, wire, wire cable, metal strip, hosing, chain and the like in a flexible film material to form a parcel for delivery to a user of the material so as to protect the material against corrosion and other damage during transportation and storage.

In some instances (such as wire and cables) the material may be coiled onto an axially open cylindrical sleeve, in others (such as strip metal) the material may be coiled onto a mandrel which is subsequently removed before envelopment. This invention also relates to a wrapped product having an open hollow cylindrical centre.

BACKGROUND OF INVENTION

While this invention will be described principally with reference to wrapping steel and aluminum strip coils, it will be appreciated that many other types of annular products, such as wire, paper and cable can also be wrapped according to the invention In order to protect strip metal coils it is conventional practice to wrap the coils in a substantially water impermeable, pliable, flexible wrapping medium such as a stretch wrap thermoplastics film, such as polyvinyl chloride or polyethylene, which is chemically inert, proof against water and other liquids, vapours and gases and which tends to cling to itself. The film is stretched prior to or during application and due to its property of "memory", it then seeks to return to its unstretched state. Such film materials are generally applied in either sheet form, wherein the entire article to be wrapped is simply enveloped in the sheet and any side seams may be heat sealed, or in strip form in which a strip of film is wound continuously around the article, which is rotated about an axis perpendicular to the axis of wrap application during wrapping so that eventually the entire peripheral surface of the article is covered ("cocoon wrapping").

In a recent variation of film strip wrapping (see for example, U.S. Pat. No. 5,282,347 to Cleine et al, 1 Feb. 1994), the coil to be wrapped is placed, coaxially on a pair of rotating rolls, for axial rotation and an endless track is arranged to pass through the axial bore of the coil. A shuttle carrying a coil of relatively narrow width film material is passed around the track as the coil is axially rotated, dispensing film as it does so until the entire coil is wrapped. The endless track is then opened and the wrapped coil is removed. This is known in the art as "through-the-eye" wrapping. Cocoon wrapping is relatively quick to effect as wide film material can be employed and the equipment required is relatively inexpensive, but the finished wrapped product is difficult to handle as the central axial bore is completely swathed in wrapping material so that the coil must be placed on a pallet or the like, with its axis vertical, for transportation. "Through-the-eye" wrapped coils are relatively easier to handle as the central axial bore is unimpeded and the wrapped coil can be handled, axis horizontal, with a fork lift truck or the like equipped with a horizontal "finger" or horn or by coil grabs fitted to an overhead crane. Also, having the eye of the coil open is necessary for restraining axis-horizontal coils during shipping Through-the-eye wrapping is, however, time consuming as at least twice as many rotations of the film dispenser are needed and space limitations for passing the track and film dispenser through the axial bore necessitate the use of relatively narrower film strip. Furthermore, through-the-eye wrapping equipment is relatively more expensive to wrap similar sized coils.

There is a need, therefore, for an improved wrapping method and apparatus which will provide complete, hermetic, protection for a wrapped coil product, which combines the advantages of speed and less expensive equipment associated with cocoon wrapping with the open-eye advantages.

OBJECT OF THE INVENTION

It is, therefore, an object of the present invention to provide an improved method of cocoon wrapping a coil product, while leaving the cylindrical axial centre of the coil open.

Another object of the invention is to provide an apparatus for use in the aforesaid method.

Yet another object of the invention is to provide a novel substantially hermetically sealed, wrapped coil product having an open axial bore.

BRIEF STATEMENT OF INVENTION

By one aspect of the present invention there is provided a method for wrapping an object having a substantially cylindrical peripheral surface, two end surfaces and a hollow cylindrical central space, with a flexible protective film material, comprising: inserting a cylindrical sleeve of said film material, having a length and diameter greater than the length and respective diameter of said central space into said central space so that the ends thereof project from respective ends of said central space; inserting flanged collar means into each respective projecting end of said cylindrical sleeve so as to arrange a portion of each said projecting end thereof in overlying relationship with a respective one of said end surfaces; folding each said projecting end of said cylindrical sleeve to overlie a respective one of said collar means; wrapping a continuous strip of said film material around said peripheral surface, said two end surfaces of the object and said overlain flanged collar means; and continuously sealing said continuous strip of film material to each said projecting end of said sleeve adjacent each said flanged collar means.

By another aspect of the present invention there is provided an apparatus for wrapping and sealing an object having a substantially cylindrical peripheral surface, two end surfaces and a hollow cylindrical central space, with a flexible protective film material comprising: means for inserting a cylindrical sleeve of said film material, having a length and diameter greater than the length and diameter respectively of said central space, into said central space so that respective ends thereof project from respective ends of said central space; means to insert flanged collar means into each respective projecting end of said cylindrical sleeve so as to arrange a portion of each said projecting end thereof in overlying relationship with a respective one of said end surfaces; means for folding each said projecting end of said cylindrical sleeve to overlie a respective one of said collar means; means for wrapping a continuous strip of said film material around said peripheral surface, said two end surfaces and said overlain flanged collar means; and means for sealing said continuous strip of film material continuously around each said projecting end of said cylindrical sleeve, adjacent each said flanged collar means.

By yet another aspect of the present invention there is provided a product comprising an object having a substantially cylindrical peripheral surface, two end surfaces and a hollow cylindrical central space substantially sealed within a flexible protective film envelope, said product including a cylindrical sleeve of said protective film, having a length and diameter greater than the length and diameter respectively of said central space, inserted in said central space such that respective ends thereof project from respective ends thereof; flanged collar means inserted into each projecting end of said sleeve so as to arrange a portion of each said projecting end in overlying radially outward relationship with a respective one of said end surfaces and a further portion thereof folded in an overlying radially inward relationship to said collar means; and a continuous strip of said flexible protective film enveloping said cylindrical peripheral surface, said two end surfaces and both said overlain collar means, and wherein said continuous strip of protective film is sealed continuously around each respective end of said sleeve adjacent each said collar means so as to substantially hermetically seal said object within said envelope.

DETAILED DESCRIPTION OF PREFERRED EMBODIMENTS

Figure 1:
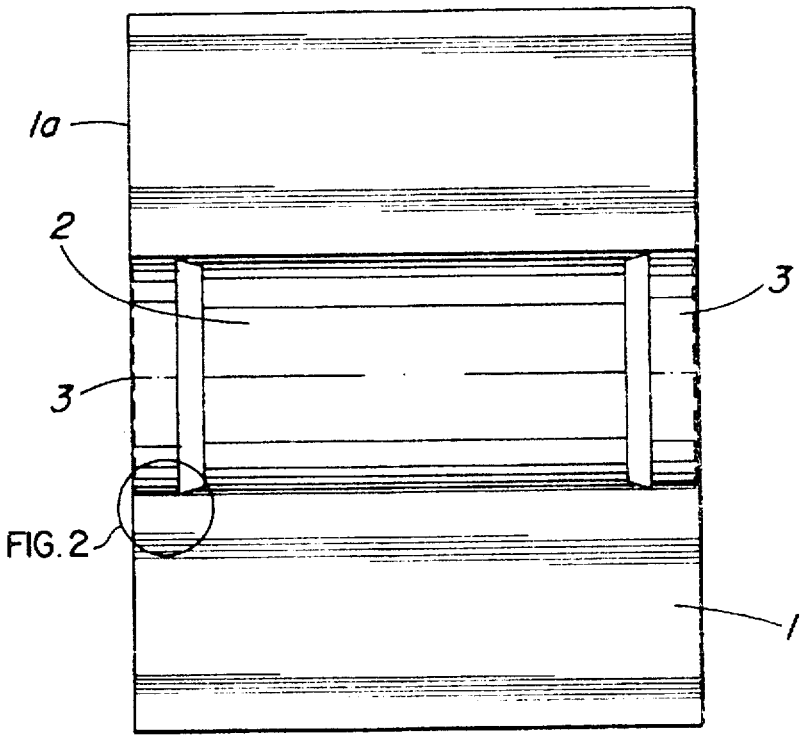
FIG. 1 is a cross-section of a coil to be wrapped according to the present invention.
Figure 2:
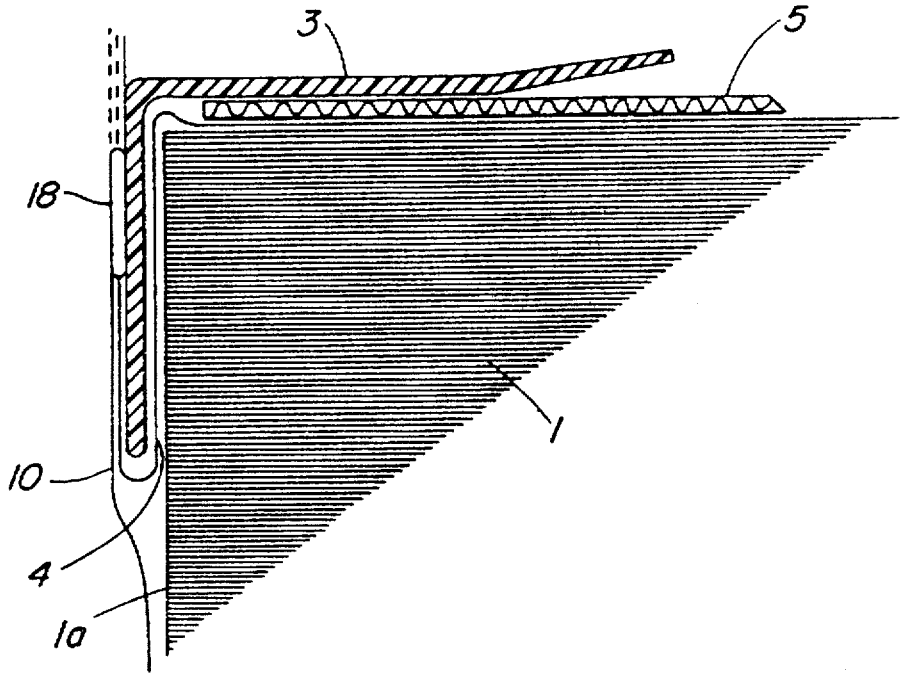
FIG. 2 is an enlarged view of part of the coil of FIG. 1.
Figure 3:
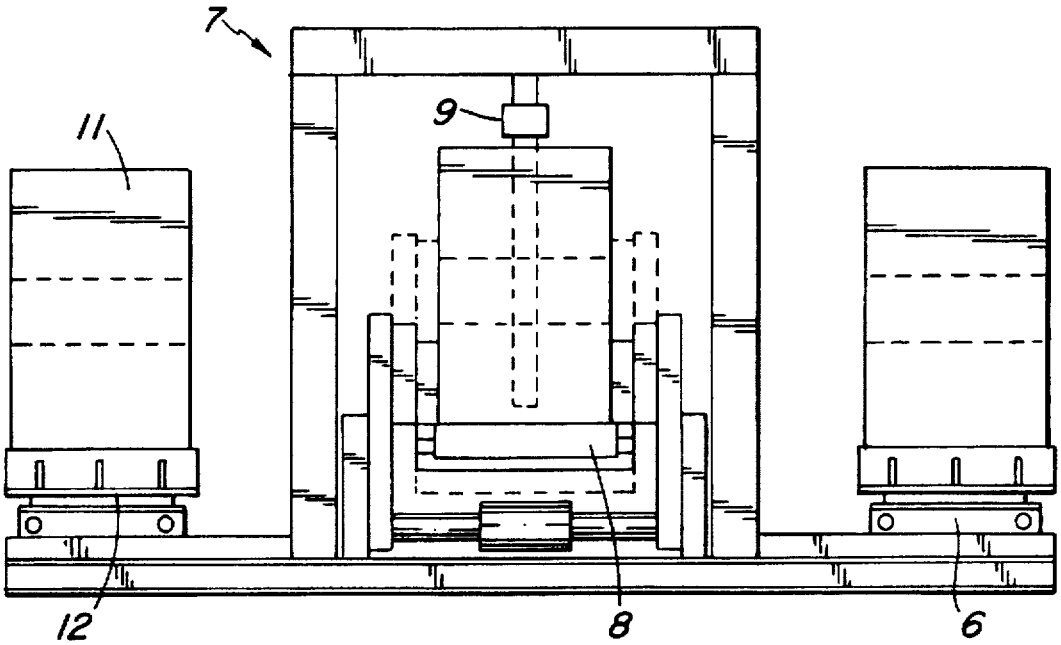
FIG. 3 is a side elevational view of a cocoon wrapping machine.
Figure 4:
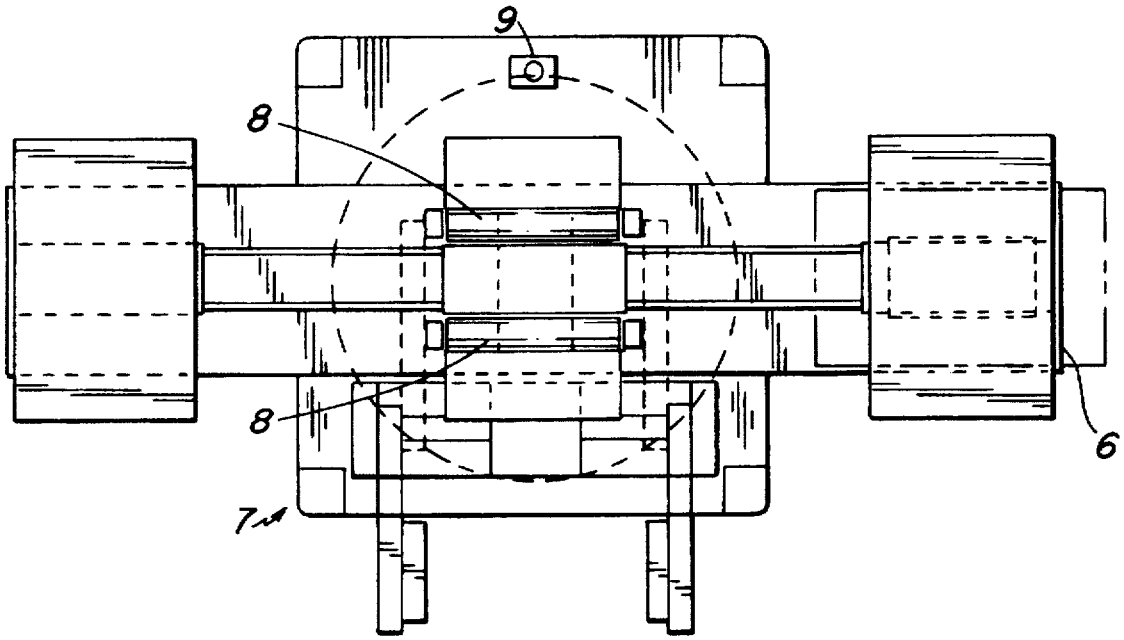
FIG. 4 is a top view of the machine of FIG. 3.
Figure 5:
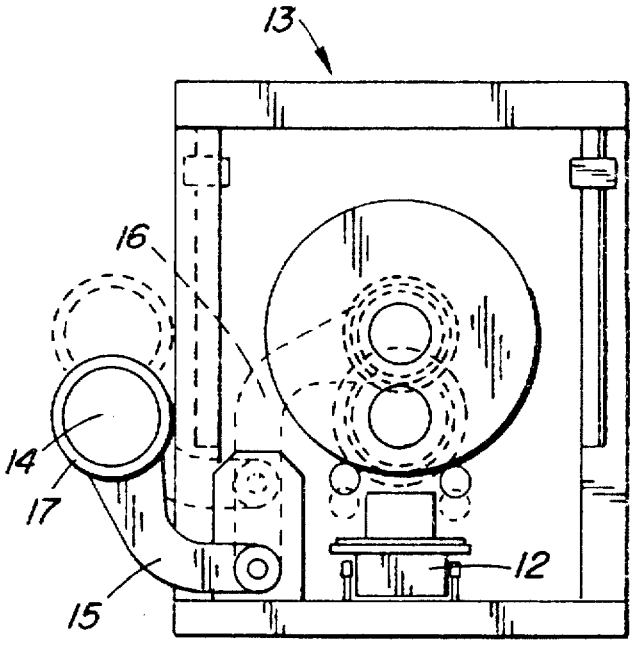
FIG. 5 is an end view of a heat seal/trim station according to the present invention.
Figure 6:
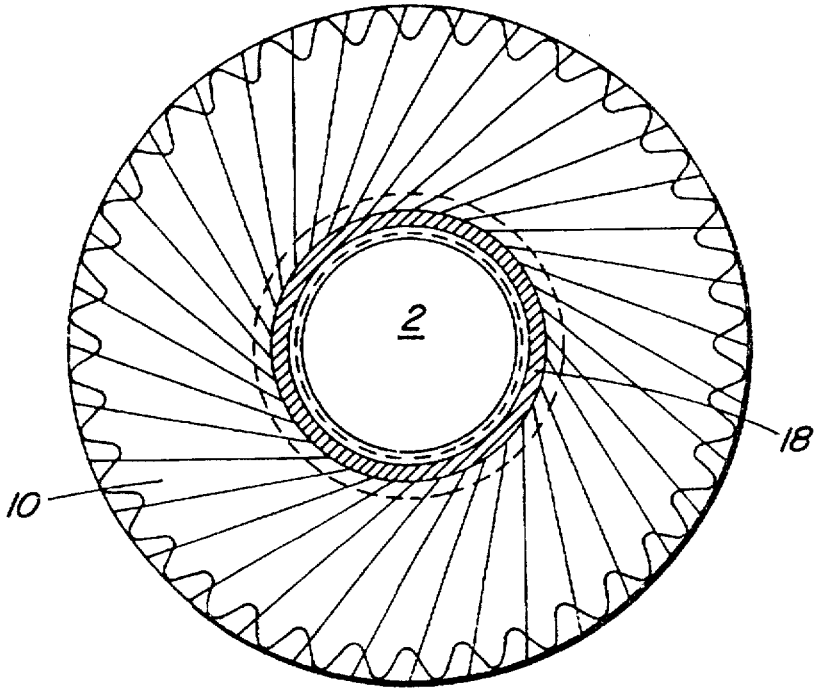
FIG. 6 is an end view of a wrapped coil according to the present invention.
Figure 7:
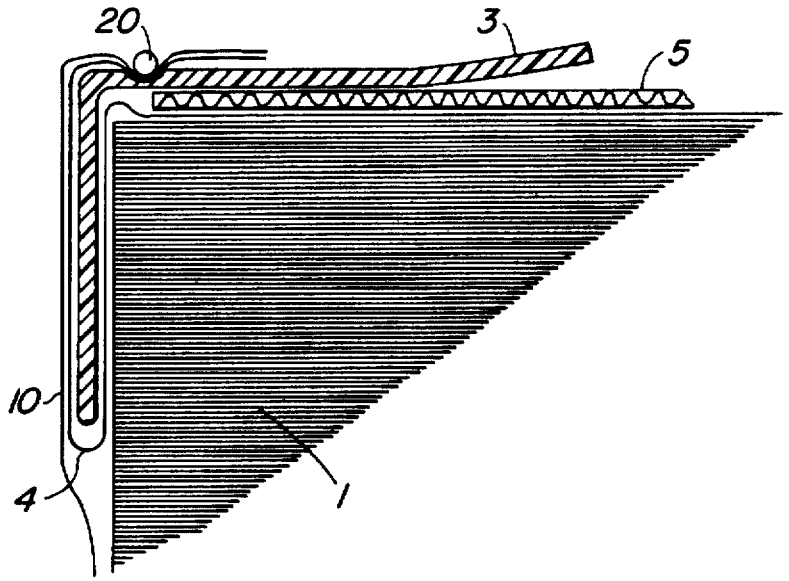
FIG. 7 is an enlarged view of part of FIG. 1 showing an alternative locking device.

In FIG. 1 there is shown a cross section of a metal coil 1 having an axial cylindrical bore 2 with a flanged collar 3, preferably a thermoplastic, inserted at each end thereof. As seen more clearly in FIG. 2, a flexible thermoplastic thin film sleeve 4, preferably a VCI impregnated polyvinyl or polyethylene material, having a diameter somewhat greater than the diameter of axial bore 2 is inserted in bore 2 and extends longitudinally from each end thereof. Preferably, but not essentially, the sleeve 4 is held in place against the inner turn of coil 1 by means of a protector cylindrical sleeve 5, such as paperboard, having a length less than the width of coil 1 and a diameter substantially equal to the diameter of bore 2. Each end of sleeve 4 is extended radially outwardly against the end surfaces 1*a* of coil 1, flanged collars 3 are inserted into each end of sleeve 4 and the free ends of sleeve 4 are folded back over their respective collars and tucked loosely into bore 2. Coil 1 is now loaded onto a coil car 6 (FIG. 3) and transferred into a cocoon wrapping station 7. Coil 1 is supported on horizontal rollers 8 which are rotated as a stretch wrap film dispensing head 9 is rotated about a vertical axis around coil 1 so as to cocoon wrap coil 1 with a plastic film 10. When wrapping is complete, an impulse weld head 14, or other sealing device (FIG. 5), is moved arcuately from a rest position 15 to an operative position 17 in which a heated ring sealer 16 having a diameter somewhat greater than the diameter of bore 2 forms a heat seal 18 between cocoon wrap film 10 and sleeve 4, as seen more clearly in FIG. 2. Alternatively, the wrapped coil 11 could be transported on a coil car 12 to a separate sealing station 13. Optionally, but not essentially, ring sealer 16 also heat seals the now welded films 10 and 4 to the plastic collar 3. Ring sealer 16 may also incorporate a circular trim element (not shown) having a diameter approximately equal to the diameter of bore 2 to sever the excess and unnecessary material of films 10 and 4 adjacent the central bore 2 as shown in FIG. 6. The severed material may then be removed to provide a free and open bore 2 to receive a horn lifting device as described hereinabove. It is emphasized that the trim element is an optional feature only, and if desired the surplus film material may simply be left in place and the cocoon wrap film 10 simply punctured when the horn is axially pushed through the bore. Hermetic sealing of the wrapped coiled product is not compromised in any way by so doing. It will be appreciated that while a heat sealing ring 17 has been illustrated, many other sealing devices are equally operative. For example, adhesive may be applied to the mating surfaces to effect sealing, and mechanical lock means could also be employed using specially grooved collars 3 in cooperation with a snap-in lock ring 20 or the like (FIG. 7).

Figure 8:
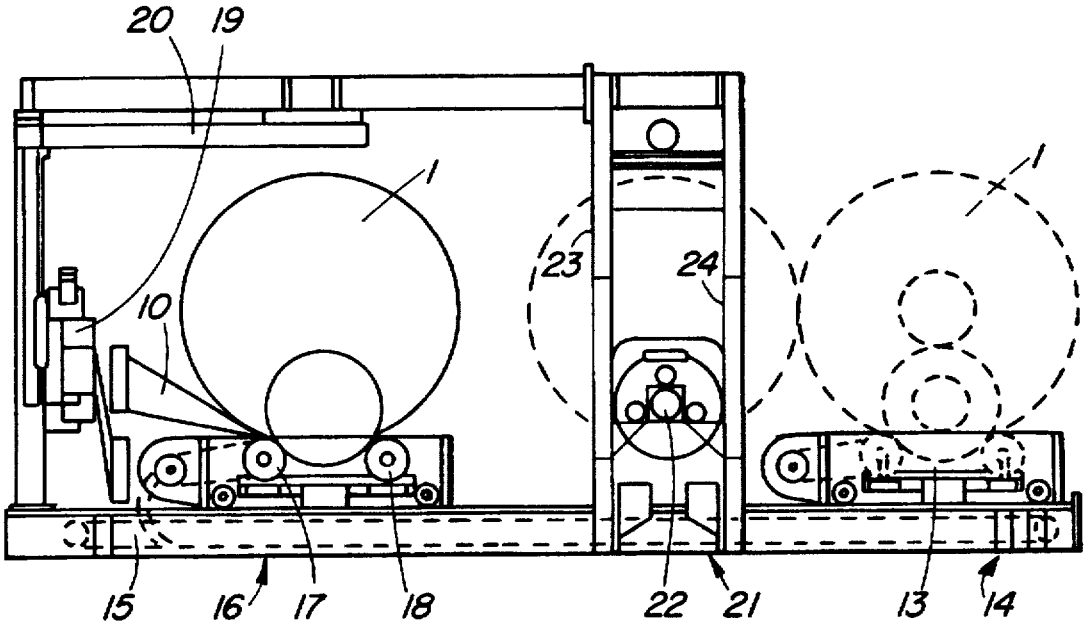
FIG. 8 is a side view of an alternative embodiment of a wrapping/sealing machine.

In FIG. 8, there is shown an alternative and somewhat simpler wrapping and sealing machine according to the present invention. A coil 1, of selected diameter (FIG. 8 shows, in phantom, the maximum and minimum diameters) is loaded onto a car 13, with its axis horizontal at a load/unload station 14. Car 13 moves along track 15 to a wrap station 16, where coil 1 is rotated about its axis on rollers 17,18 as a film 10 is dispensed from a dispenser 19 which is rotatably mounted on arm 20 for rotation around the coil 1. When wrapping is complete, film 10 is severed and car 13 moves back along track 15 to a sealing station, preferably but not essentially a heat sealing station 21, where a heat sealer 22 or the like, mounted for sliding movement on parallel rails 23,24 is positioned adjacent the collar 3 to seal the film 10 to the sleeve 4, as described hereinabove. After sealing, car 13 moves back along track 15 to the loading/unloading station 14.

In yet another, less preferred, embodiment of the invention the wrapped coil is not completely hermetically sealed within a plastic film element, but merely cocoon wrapped to provide surface protection. This may be effected simply by omitting the sleeve 4 and securing the plastic film 10 directly to collars 3 by heat sealing, adhesive or mechanical means as described hereinabove.

I claim:

1. A product comprising an object having a substantially cylindrical peripheral surface, two end surfaces and a hollow cylindrical central space substantially sealed within a flexible protective film envelope, said product including a cylindrical sleeve of said protective film, having a length and diameter greater than the length and diameter respectively of said central space, inserted in said central space such that respective ends of said cylindrical sleeve project from respective ends of said central space; flanged collar means inserted into said central space to position a projecting end portion of said cylindrical sleeve against each said end surface; an end of said projecting end portion of said cylindrical sleeve folded to overlay each said flanged collar; and a continuous strip of said flexible protective film enveloping said cylindrical peripheral surface, said two end surfaces and both said overlain collar means, and wherein said protective film is sealed around each respective end of said sleeve adjacent each said collar means so as to seal said object within said envelope.

2. A product as claimed in claim 1 wherein said object is selected from the group consisting of aluminum and steel strip coils.

3. A product as claimed in claim 1 wherein said flexible protective film is a stretch wrap thermoplastic film.

4. A product as claimed in claim 3 wherein said thermoplastic film is selected from polyvinyl chloride and polyethylene.

5. A product as claimed in claim 1 including cylindrical protector means having a diameter equal to the diameter of said central space inserted in said central space.

6. A product as claimed in claim 5 wherein said protector means comprises a paperboard tube.

7. A product as claimed in claim 1 wherein said continuous strip of protective film is heat sealed to said sleeve.

8. A product as claimed in claim 7 wherein said continuous strip of protective film is heat sealed to said sleeve and to said collar means.

9. A product as claimed in claim 1 wherein said continuous strip of protective film is adhesively sealed to said sleeve.

10. A product as claimed in claim 1 wherein said continuous strip of protective film is mechanically secured to said sleeve and said collar means.

11. A product as claimed in claim 10 wherein said collar means includes groove means adapted to receive a sealing ring means.

12. A product as claimed in claim 1 wherein said protective film is a continuous strip.

13. A product as claimed in claim 3 wherein said film hermetically seals said object within said envelope.

14. A product as claimed in claim 9 wherein said film is also adhesively secured to said collar means.

15. A product comprising an object having a substantially cylindrical peripheral surface, two end surfaces and a hollow cylindrical central space, said product including two flanged collar means each having a central collar portion inserted into a respective end of said hollow cylindrical central space and a radially extending flange portion having inner and outer planar faces overlying a respective end surface; and flexible stretch wrap protective film under tension enveloping said cylindrical peripheral surface, said two end surfaces and both flange portions of said collar means, and wherein said stretch wrap protective film is heat sealed continuously around said outer planar face of each said flange portion of said collar means so as to secure said stretch wrap protective film and said collar means to said object.

16. A product as claimed in claim 15 wherein said protective film is a continuous strip.

* * * * *